US009972281B2

(12) United States Patent
Park et al.

(10) Patent No.: US 9,972,281 B2
(45) Date of Patent: May 15, 2018

(54) METHOD OF COMPENSATING IMAGE TO BE DISPLAYED ON DISPLAY PANEL

(71) Applicant: Samsung Display Co., Ltd., Yongin, Gyeonggi-do (KR)

(72) Inventors: Dong-Won Park, Hwaseong-si (KR); Yong-Jun Jang, Yongin-si (KR); Gi-Geun Kim, Seoul (KR); Won-Sik Oh, Seoul (KR); Eun-Ho Lee, Suwon-si (KR); Hyun-Dae Lee, Hwaseong-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 439 days.

(21) Appl. No.: 14/321,623

(22) Filed: Jul. 1, 2014

(65) Prior Publication Data

US 2015/0130860 A1 May 14, 2015

(30) Foreign Application Priority Data

Nov. 14, 2013 (KR) ..... 10-2013-0138594

(51) Int. Cl.
*G09G 3/36* (2006.01)
*G09G 5/18* (2006.01)
*G09G 3/3225* (2016.01)

(52) U.S. Cl.
CPC ..... *G09G 5/18* (2013.01); *G09G 3/3225* (2013.01); *G09G 3/3648* (2013.01); *G09G 2320/046* (2013.01); *G09G 2360/16* (2013.01)

(58) Field of Classification Search
None
See application file for complete search history.

(56) References Cited

U.S. PATENT DOCUMENTS 5,172,227 A * 12/1992 Tsai ..... H04N 1/58 348/E9.01
7,412,106 B1 * 8/2008 Nadabar ..... G06K 19/06037 345/611

(Continued)

FOREIGN PATENT DOCUMENTS

JP 2007-334520 A 12/2007
KR 10-0238045 B1 10/1999

(Continued)

OTHER PUBLICATIONS

Computer Vision: Filtering by Rauciel Urtasun (TTI Chicago puiblished on Jan. 10, 2013).*

*Primary Examiner* — Kent Chang
*Assistant Examiner* — Benjamin Morales Fernande
(74) *Attorney, Agent, or Firm* — Knobbe Martens Olson & Bear LLP

(57) ABSTRACT

A method of compensating an image to be display on a display panel is disclosed. In one aspect, the method includes receiving a first input image and adjusting a contrast sensitivity of the first input image. The method also includes calculating a first derivative of luminance of a pixel included in the adjusted image, calculating a second derivative of the luminance of the pixel, and accumulating the first and second derivatives. The method further includes determining a burn-in causing boundary based at least in part on the accumulated first and second derivatives, receiving a second input image, and comparing the burn-in causing boundary to a boundary of the second input image to determine whether to apply burn-in compensation. The method finally includes compensating a portion of the second input image corresponding to the burn-in causing boundary based at least in part on an unsharpening filter.

8 Claims, 9 Drawing Sheets

(56) References Cited

U.S. PATENT DOCUMENTS

2005/0195280 A1* 9/2005 Murakami ..... G09G 3/007 348/173
2007/0098290 A1* 5/2007 Wells ..... G06T 7/0081 382/254
2008/0106649 A1* 5/2008 Prusia ..... G09G 5/003 348/701
2009/0027558 A1* 1/2009 Mantiuk ..... H04N 1/6027 348/673
2009/0238466 A1* 9/2009 Golan ..... G06K 9/4609 382/199
2010/0007656 A1* 1/2010 Okamoto ..... G09G 3/3233 345/214
2010/0085285 A1* 4/2010 Ozawa ..... G09G 3/3233 345/77
2010/0310191 A1* 12/2010 Sato ..... H04N 7/0132 382/276
2011/0085738 A1* 4/2011 Kitamura ..... G06T 5/002 382/199
2011/0234643 A1 9/2011 Park et al.
2012/0263353 A1* 10/2012 Kitajima ..... G01S 7/4802 382/106
2013/0257887 A1* 10/2013 Xu ..... G09G 5/10 345/589
2014/0160142 A1* 6/2014 Lee ..... G09G 3/3208 345/589
2015/0254829 A1* 9/2015 Araki ..... G01B 11/24 382/141

FOREIGN PATENT DOCUMENTS

KR 10-2005-0022543 A 3/2005
KR 10-2005-0036655 A 4/2005
KR 10-2008-0034590 A 4/2008
KR 10-2009-0025573 A 3/2009
KR 10-2010-0005979 A 1/2010
KR 10-0999888 B1 12/2010
KR 10-2011-0024481 A 3/2011
KR 10-2011-0054597 A 5/2011

* cited by examiner

METHOD OF COMPENSATING IMAGE TO BE DISPLAYED ON DISPLAY PANEL

CROSS-REFERENCE TO RELATED APPLICATIONS

This application claims priority under 35 U.S.C. § 119 to Korean Patent Application No. 10-2013-0138594, filed on Nov. 14, 2013 in the Korean Intellectual Property Office KIPO, the contents of which are herein incorporated by reference in their entireties.

CROSS-REFERENCE TO RELATED APPLICATIONS

The described technology generally relates to a method of compensating an image on a display panel.

DESCRIPTION OF THE RELATED TECHNOLOGY

Display devices include a display panel and a panel driver. Display panels include a plurality of gate lines and a plurality of data lines. The panel driver includes a gate driver applying gate signals to the gate lines and a data driver applying data voltages to the data lines.

Display panels display images in response to the gate signals and the data voltages. When the same image is repeatedly displayed on a display panel and a different image is subsequently displayed on the display panel, image burn-in or ghost images can result.

SUMMARY OF CERTAIN INVENTIVE ASPECTS

One inventive aspect is a method of compensating an image on a display panel for preventing image burn-in, and thus, improving display quality.

Another aspect is a method of compensating an image on a display panel to prevent image burn-in to improve display quality.

Another aspect is a method of compensating an image on a display panel, the method including emphasizing a boundary of an input image to generate a contrast sensitivity adjusted image, determining a first derivative of luminance of a pixel of the contrast sensitivity adjusted image, determining a second derivative of the luminance of the pixel of the contrast sensitivity adjusted image, determining a burn-in causing boundary based on an accumulated first derivative and an accumulated second derivative, comparing the burn-in causing boundary and a boundary of a present input image to determine a necessity of burn-in compensation and compensating a portion of the present input image corresponding to the burn-in causing boundary using an unsharpening filter.

The emphasizing the boundary of the input image may include converting luminance of the input image into a frequency domain, multiplying the luminance profile of the input image in the frequency domain and contrast sensitivity function defined in the frequency domain and converting the multiplied value into a time domain.

The determining the first derivative may use a first mask which is at least one of $$\begin{pmatrix} -1 & -2 & -1 \\ 0 & 0 & 0 \\ 1 & 2 & 1 \end{pmatrix} \text{ and } \begin{pmatrix} -1 & 0 & 1 \\ -2 & 0 & 2 \\ -1 & 0 & 1 \end{pmatrix}.$$

The determining the second derivative may use a second mask which is at least one of $$\begin{pmatrix} 0 & 1 & 0 \\ 1 & -4 & 1 \\ 0 & 1 & 0 \end{pmatrix}, \begin{pmatrix} 0 & -1 & 0 \\ -1 & 4 & -1 \\ 0 & -1 & 0 \end{pmatrix}, \begin{pmatrix} 1 & 1 & 1 \\ 1 & -8 & 1 \\ 1 & 1 & 1 \end{pmatrix}, \text{ and } \begin{pmatrix} -1 & -1 & -1 \\ -1 & 8 & -1 \\ -1 & -1 & -1 \end{pmatrix}.$$

The method may further include determining the luminance of the pixel of the contrast sensitivity adjusted image.

The determining of the burn-in causing boundary may include determining or calculating weighted sum of an accumulated luminance, the accumulated first derivative, and the accumulated second derivative.

The unsharpening filter may be an averaging filter.

The unsharpening filter may be $$\begin{pmatrix} 1/9 & 1/9 & 1/9 \\ 1/9 & 1/9 & 1/9 \\ 1/9 & 1/9 & 1/9 \end{pmatrix}.$$

Another aspect is a method of compensating an image on a display panel, the method including emphasizing a boundary of an input image to generate a contrast sensitivity adjusted image, determining a first derivative of luminance of a pixel of the contrast sensitivity adjusted image, determining a second derivative of the luminance of the pixel of the contrast sensitivity adjusted image, determining a burn-in causing boundary based on an accumulated first derivative and an accumulated second derivative, comparing the burn-in causing boundary and a boundary of a present input image to determine a necessity of burn-in compensation and displacing the input image in different positions according to frames to compensate burn-in of the input image.

The displacing of the input image may include displaying the input image at a first position in a first frame, displaying the input image at a second position in a second frame, the second position displaced by a distance of a from the first position in a first direction, displaying the input image at a third position in a third frame, the third position displaced by a distance of b from the second position in a second direction crossing the first direction, displaying the input image at a fourth position in a fourth frame, the fourth position displaced by a distance of—a from the third position in the first direction and displaying the input image at the first position in a fifth frame.

The distances of a and b may vary according to a burn-in causing degree determined based on the first derivative and the second derivative.

When the burn-in causing degree increases, the distances of a and b may increase. When the burn-in causing degree decreases, the distances of a and b may decrease.

The distance of a may be substantially the same as the distance of b.

Another aspect is a method of compensating an image on a display panel, the method including emphasizing a boundary of an input image to generate a contrast sensitivity adjusted image, determining a first derivative of luminance of a pixel of the contrast sensitivity adjusted image, determining a second derivative of the luminance of the pixel of the contrast sensitivity adjusted image, determining a burn-in causing boundary based on an accumulated first derivative and an accumulated second derivative, comparing the burn-in causing boundary and a boundary of a present input image to determine a necessity of burn-in compensation and inserting a compensating image including a first compensating portion corresponding to the burn-in causing boundary and a second compensating portion not corresponding to the burn-in causing boundary between original input images to compensate burn-in of the input image.

The first compensating portion may be generated by applying a mask of $$\begin{pmatrix} 0 & 1 & 0 \\ 1 & -4 & 1 \\ 0 & 1 & 0 \end{pmatrix}$$

to a portion of the original input image corresponding to the burn-in causing boundary.

The second compensating portion may display a black image.

The second compensating portion may display a gray image corresponding to an average of luminance of the original input image.

Another aspect is a method of compensating an image on a display panel, the method including emphasizing a boundary of an input image to generate a contrast sensitivity adjusted image, determining luminance of a pixel of the contrast sensitivity adjusted image, determining a first derivative of the luminance of the pixel of the contrast sensitivity adjusted image, determining a second derivative of the luminance of the pixel of the contrast sensitivity adjusted image, determining a burn-in causing boundary based on an accumulated first derivative and an accumulated second derivative, determining a necessity of burn-in compensation based on an accumulated luminance and a difference of the burn-in causing boundary and a boundary of the present input image and increasing luminance of an image displayed at a first portion having a relatively low accumulated luminance or decreasing luminance of an image displayed at a second portion having a relatively high accumulated luminance to compensate burn-in of the input image.

The luminance of the first portion may be decreased. The luminance of the first portion may be relatively great at a position in the first portion close to a boundary between the first portion and the second portion The luminance of the second portion may be increased. The luminance of the second portion may be relatively great at a position in the first portion close to a boundary between the first portion and the second portion.

Another aspect is a display device including a display panel including a plurality of pixels, a data driver configured to apply data signals to the pixels, and a controller configured to receive first and second input images and control the data driver based at least in part on a burn-in causing boundary of the first input image, wherein the controller is further configured to at least partially compensate the second input image based at least in part on the burn-in causing boundary, and wherein the controller is further configured to adjust the contrast sensitivity of the first input image and determine the burn-in causing boundary based at least in part on the adjusted image.

The controller further executes software that includes a contrast sensitivity adjuster configured to adjust the contrast sensitivity of the first input image, a gradient analyzer configured to calculate a first derivative of the luminance of a pixel included in the adjusted image and accumulate the first derivative, a local maximum analyzer configured to calculate a second derivative of the luminance of the pixel and accumulate the second derivative, a boundary determination module configured to determine the burn-in causing boundary based on the accumulated first and second derivatives, a compensation determination module configured to determine whether to apply burn-in compensation based on the burn-in causing boundary and the second input image, and a compensator configured to compensate a portion of the second input image corresponding to the burn-in causing boundary.

The compensator includes an unsharpening filter configured to compensate the second input image. The second input image includes a plurality of consecutive frames and the compensator is further configured to displace the second input image in a different direction for each of the consecutive frames.

The second input image includes a plurality of frames and the compensator is further configured to insert a compensating image including a first compensating portion corresponding to the burn-in causing boundary and a second compensating portion not corresponding to the burn-in causing boundary between adjacent frames of the second input image.

The display device further includes a luminance analyzer configured to determine the luminance of the pixel and accumulate the luminance, wherein the compensator is further configured to decrease the luminance of a first portion of the second image when the first portion has an accumulated luminance less than a first predetermined luminance or increase the luminance of a second portion of the second image when the second portion has an accumulated luminance greater than a second predetermined luminance.

According to at least one embodiment, a burn-in causing boundary of the image on the display panel is determined and compensated based on a contrast sensitivity adjusted image which considers the sensitivity characteristics of a user so that image burn-in can be substantially prevented. Thus, display quality of the display panel is improved.

DETAILED DESCRIPTION OF CERTAIN INVENTIVE EMBODIMENTS

The standard method of detecting image burn-in includes using the absolute luminance of the displayed image. However, the boundary of a burned-in image has unique perceived optical properties. Thus, when the image burn-in is detected and compensated using absolute luminance, it may not be accurately compensated for.

Hereinafter, the described technology will be explained in detail with reference to the accompanying drawings.

Figure 1:
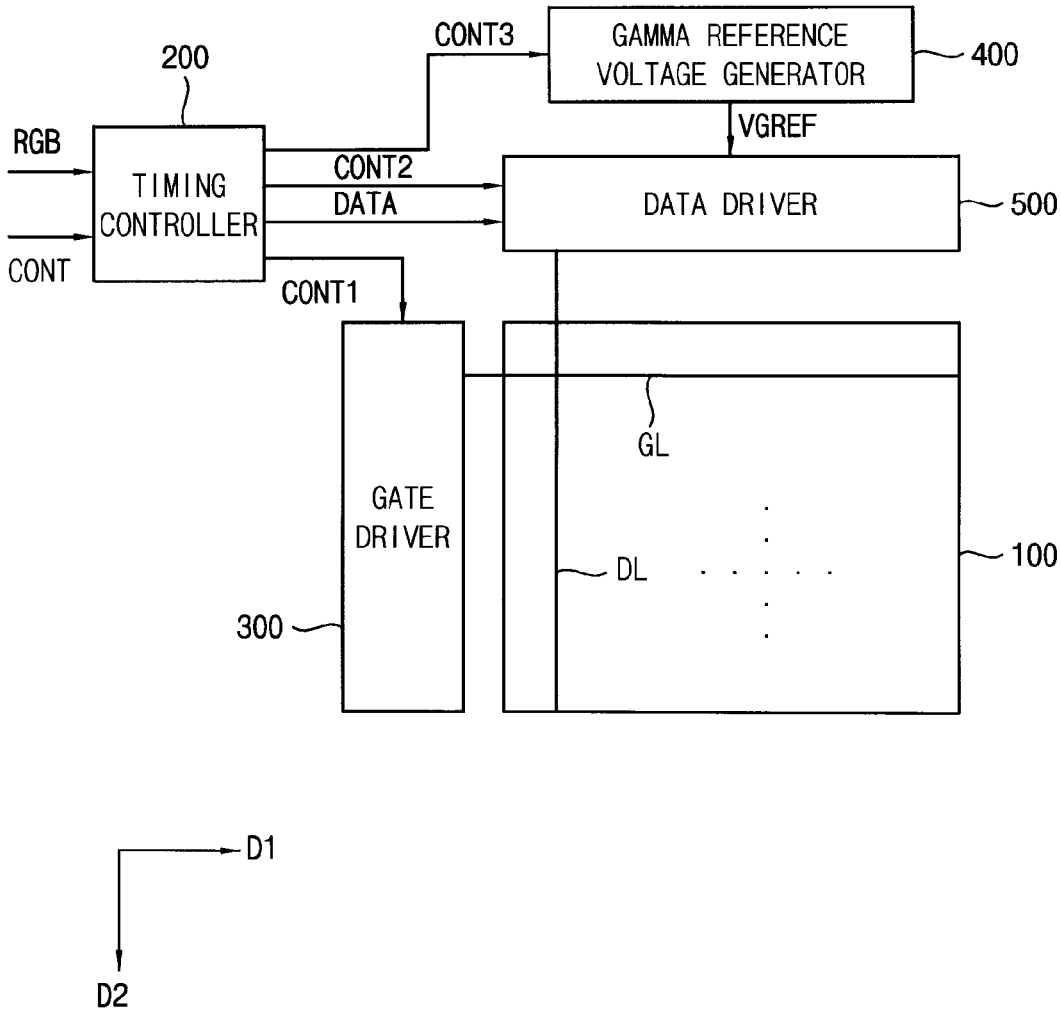
FIG. 1 is a block diagram illustrating a display device according to an exemplary embodiment.

FIG. 1 is a block diagram illustrating a display device according to an exemplary embodiment.

Referring to FIG. 1, the display device includes a display panel 100 and a panel driver. The panel driver includes a timing controller 200, a gate driver 300, a gamma reference voltage generator 400, and a data driver 500.

The display panel 100 includes a display region on which images are displayed and a peripheral region adjacent to the display region.

The display panel 100 includes a plurality of gate lines GL, a plurality of data lines DL, and a plurality of pixels connected to the gate lines GL and the data lines DL. The gate lines GL extend in a first direction D1 and the data lines DL extend in a second direction D2 crossing the first direction D1.

In the embodiment of FIG. 1, each pixel includes a switching element (not shown), a liquid crystal capacitor (not shown), and a storage capacitor (not shown). The liquid crystal capacitor and the storage capacitor are electrically connected to the switching element. The unit pixels may be disposed in a matrix.

The display panel 100 may be a liquid crystal display (LCD) panel including a liquid crystal layer. Alternatively, the display panel 100 may be an organic light-emitting diode (OLED) display panel including a plurality of OLEDs.

The timing controller 200 receives input image data RGB and an input control signal CONT from an external source (not shown). The input image data may include red image data R, green image data G, and blue image data B. The input control signal CONT may include a master clock signal and a data enable signal. The input control signal CONT may include a vertical synchronizing signal and a horizontal synchronizing signal.

The timing controller 200 generates a first control signal CONT1, a second control signal CONT2, a third control signal CONT3, and a data signal DATA based on the input image data RGB and the input control signal CONT.

The timing controller 200 may generate a contrast sensitivity adjusted image based on the input image data RGB. The timing controller 200 may analyze the contrast sensitivity adjusted image to determine burn-in causing boundary. The timing controller 200 may compensate the burn-in causing boundary to generate the data signal DATA.

The timing controller 200 generates the first control signal CONT1 for controlling the operations of the gate driver 300 based on the input control signal CONT and outputs the first control signal CONT1 to the gate driver 300. The first control signal CONT1 may further include a vertical start signal and a gate clock signal.

The timing controller 200 generates the second control signal CONT2 for controlling the operations of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 generates the third control signal CONT3 for controlling the operations of the gamma reference voltage generator 400 based on the input control signal CONT and outputs the third control signal CONT3 to the gamma reference voltage generator 400.

The structure and operation of the timing controller 200 will be explained in detail with reference to FIG. 2.

The gate driver 300 generates gate signals for driving the gate lines GL in response to the first control signal CONT1 received from the timing controller 200. The gate driver 300 sequentially outputs the gate signals to the gate lines GL.

The gate driver 300 may be directly mounted on the display panel 100 or may be connected to the display panel 100 in a tape carrier package ("TCP"). Alternatively, the gate driver 300 may be integrated on the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to the level of the data signal DATA.

In some embodiments, the gamma reference voltage generator 400 is formed in the timing controller 200 or in the data driver 500.

The data driver 500 receives the second control signal CONT2 and the data signal DATA from the timing controller 200 and receives the gamma reference voltages VGREF from the gamma reference voltage generator 400. The data driver 500 converts the data signal DATA into analog data voltages using the gamma reference voltages VGREF. The data driver 500 sequentially outputs the data voltages to the data lines DL.

The data driver 500 may be directly mounted on the display panel 100 or may be connected to the display panel 100 as a TCP. Alternatively, the data driver 500 may be integrated on the display panel 100.

Figure 2:
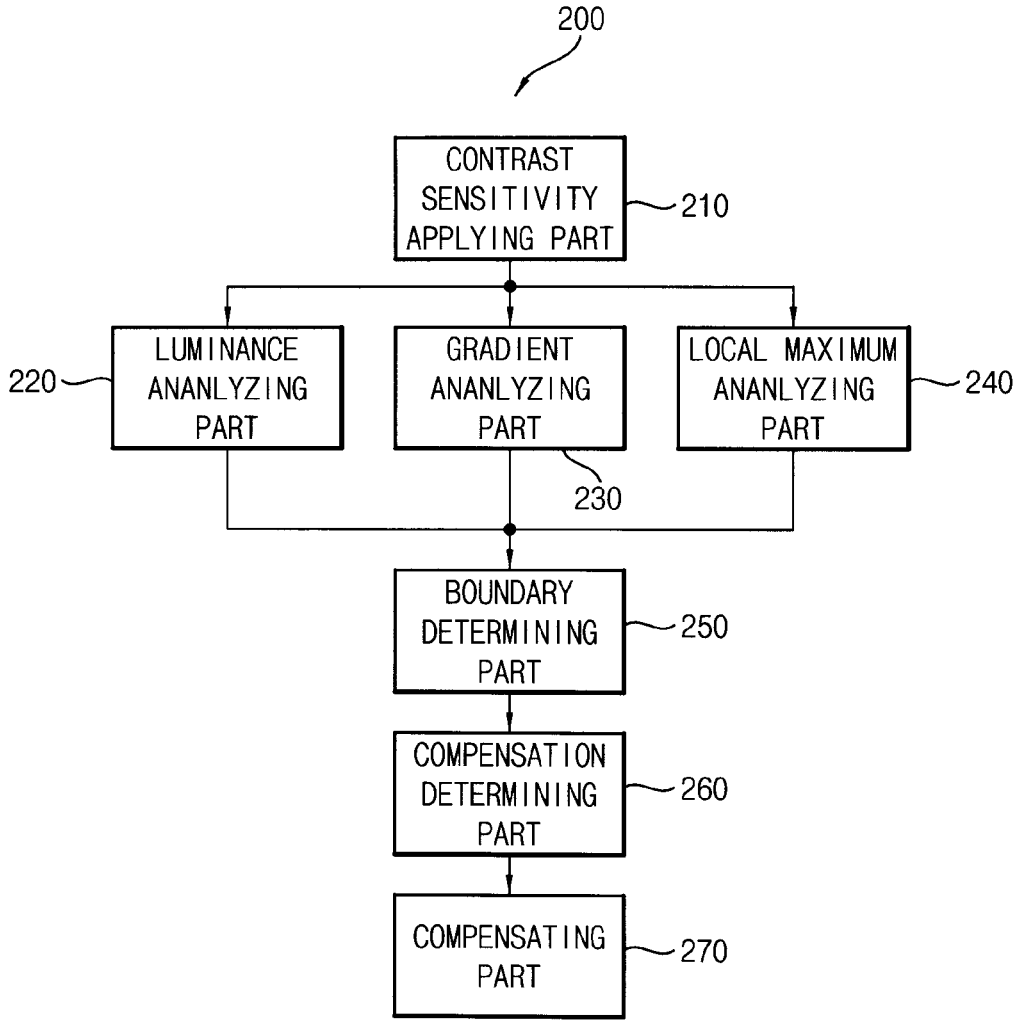
FIG. 2 is a block diagram illustrating the timing controller of FIG. 1.

FIG. 2 is a block diagram illustrating the timing controller of FIG. 1.

Referring to FIGS. 1 and 2, the timing controller 200 includes a contrast sensitivity applying part or contrast sensitivity application module 210, a gradient analyzing part or gradient analysis module 230, a local maximum analyzing part or local maximum analysis module 240, a boundary determining part or boundary determining module 250, a compensation determining part or compensation determining module 260, and a compensating part or compensating module 270. The timing controller 200 may further include a luminance analyzing part or luminance analysis module 220.

The contrast sensitivity applying part 210 emphasizes a boundary of the input image RGB to generate the contrast sensitivity adjusted image. In other words, the contrast sensitivity applying part 120 adjusts the contrast sensitivity of the input image RGB. An optical illusion may be perceived by to human eyes at the boundary between difference luminances in a display image. For example, when there is a boundary between pixels displaying black and white in the displayed image and the difference in absolute luminance between the black and white pixels is about 10, the difference in luminances at the boundary between the black and white pixels is perceived as greater than 10. Thus, when the boundary of the input image RGB is emphasized via adjusting the contrast sensitivity of the image, the adjusted image may be perceived as closer to the original image.

In addition, when the boundary between black and white is included in the displayed image and a first gray portion adjacent to a black portion has the same luminance as a second gray portion adjacent to a white portion, an illusion where the first gray is darker than the second gray is perceived. Thus, by decreasing the luminance of the first gray portion, the adjusted image may be perceived as closer to original image.

A method of generating the contrast sensitivity adjusted image will be explained in detail with reference to FIG. 3.

The luminance analyzing part 220 analyzes the luminance of each pixel of the contrast sensitivity adjusted image.

The gradient analyzing part 230 analyzes or calculates a first derivative of the luminance of each pixel of the contrast sensitivity adjusted image. In some embodiments, the gradient analyzing part 230 analyzes a first derivative of the luminance of each pixel of the contrast sensitivity adjusted image in a first direction D1. In other embodiments, the gradient analyzing part 230 analyzes a first derivative of the luminance of each pixel of the contrast sensitivity adjusted image in a second direction D2. In yet other embodiments, the gradient analyzing part 230 analyzes a first derivative of the luminance of each pixel of the contrast sensitivity adjusted image in the first direction D1 and the second direction D2.

The first derivative may be calculated using a mask. According to at least one embodiment, the mask is one of $$\begin{pmatrix} -1 & -2 & -1 \\ 0 & 0 & 0 \\ 1 & 2 & 1 \end{pmatrix} \text{ or } \begin{pmatrix} -1 & 0 & 1 \\ -2 & 0 & 2 \\ -1 & 0 & 1 \end{pmatrix}.$$

In some embodiments, the first derivative is calculated using the both masks $$\begin{pmatrix} -1 & -2 & -1 \\ 0 & 0 & 0 \\ 1 & 2 & 1 \end{pmatrix} \text{ and } \begin{pmatrix} -1 & 0 & 1 \\ -2 & 0 & 2 \\ -1 & 0 & 1 \end{pmatrix}.$$

The local maximum analyzing part 240 analyzes or calculates a second derivative of the luminance of each pixel of the contrast sensitivity adjusted image. In some embodiments, the local maximum analyzing part 240 analyzes a second derivative of the luminance of each pixel of the contrast sensitivity adjusted image in the first direction D1. In other embodiments, the local maximum analyzing part 240 analyzes a second derivative of the luminance of each pixel of the contrast sensitivity adjusted image in the second direction D2. In yet other embodiments, the local maximum analyzing part 240 analyzes a second derivative of the luminance of each pixel of the contrast sensitivity adjusted image in the first direction D1 and the second direction D2.

The second derivative may be calculated using a mask. According to at least one embodiment, the mask is one of $$\begin{pmatrix} 0 & 1 & 0 \\ 1 & -4 & 1 \\ 0 & 1 & 0 \end{pmatrix}, \begin{pmatrix} 0 & -1 & 0 \\ -1 & 4 & -1 \\ 0 & -1 & 0 \end{pmatrix}, \begin{pmatrix} 1 & 1 & 1 \\ 1 & -8 & 1 \\ 1 & 1 & 1 \end{pmatrix} \text{ and } \begin{pmatrix} -1 & -1 & -1 \\ -1 & 8 & -1 \\ -1 & -1 & -1 \end{pmatrix}.$$

In some embodiments, the second derivative is calculated using the masks $$\begin{pmatrix} 0 & 1 & 0 \\ 0 & -4 & 1 \\ 0 & 1 & 0 \end{pmatrix} \text{ and } \begin{pmatrix} 0 & -1 & 0 \\ -1 & 4 & -1 \\ 0 & -1 & 0 \end{pmatrix}.$$

In other embodiments, the second derivative is calculated using the masks $$\begin{pmatrix} 1 & 1 & 1 \\ 1 & -8 & 1 \\ 1 & 1 & 1 \end{pmatrix} \text{ and } \begin{pmatrix} -1 & -1 & -1 \\ -1 & 8 & -1 \\ -1 & -1 & -1 \end{pmatrix}.$$

In yet other embodiments, the second derivative is calculated using the masks $$\begin{pmatrix} 0 & 1 & 0 \\ 1 & -4 & 1 \\ 0 & 1 & 0 \end{pmatrix}, \begin{pmatrix} 0 & -1 & 0 \\ -1 & 4 & -1 \\ 0 & -1 & 0 \end{pmatrix}, \begin{pmatrix} 1 & 1 & 1 \\ 1 & -8 & 1 \\ 1 & 1 & 1 \end{pmatrix} \text{ and } \begin{pmatrix} -1 & -1 & -1 \\ -1 & 8 & -1 \\ -1 & -1 & -1 \end{pmatrix}.$$

The boundary determining part 250 determines a burn-in causing boundary based on an accumulated first derivative and an accumulated second derivative. In some embodiments, the boundary determining part 250 determines a burn-in causing degree using a weighted sum of the accumulated first derivative and the accumulated second derivative. The accumulated first derivative and the accumulated second derivative are properly scaled to calculate the weighted sum of the accumulated first derivative and the accumulated second derivative.

Alternatively, the boundary determining part 250 determines the burn-in causing boundary based on an accumulated luminance, the accumulated first derivative, and the accumulated second derivative. In some embodiments, the boundary determining part 250 determines the burn-in causing degree using a weighted sum of the accumulated luminance, the accumulated first derivative, and the accumulated second derivative.

The boundary determining part 250 compares the burn-in causing degree and a burn-in causing threshold. When the burn-in causing degree is greater than the burn-in causing threshold, the boundary determining part 250 determines the boundary of the image as the burn-in causing boundary.

When the burn-in causing boundary is determined by the boundary determining part 250, the compensation determining part 260 compares the burn-in causing boundary and a boundary pattern of a present input image to determine whether to apply the burn-in compensation. When the boundary pattern of the present input image is the same as the burn-in causing boundary, the compensation determining part 260 determines to compensate the present input image. When the boundary pattern of the present input image is different from the burn-in causing boundary, the compensation determining part 260 determines not to compensate the present input image.

The boundary of the present input image is generated using a first derivative and a second derivative of a present contrast sensitivity adjusted image. The present contrast sensitivity adjusted image is generated by filtering the present input image using a contrast sensitivity filter.

In addition, when luminance of the boundary of the present input image which is determined by the luminance analyzing part 220 is less than a luminance threshold, the compensation determining part 260 determines to compensate the present input image. When the luminance of the boundary of the present input image is sufficiently great, the burn-in is rarely perceived by a user. Thus, although the burn-in causing boundary is determined, the compensation may not be necessary.

When the compensation determining part 260 determines to compensate the burn-in of the present input image, the compensating part 270 compensates the burn-in of the present input image.

In the embodiment of FIG. 2, the compensating part 270 compensates the present input image by filtering a portion of the image corresponding to the burn-in causing boundary using an unsharpening filter.

The operation of the compensating part 270 will be explained in detail with reference to FIGS. 4A to 4C.

Figure 3:
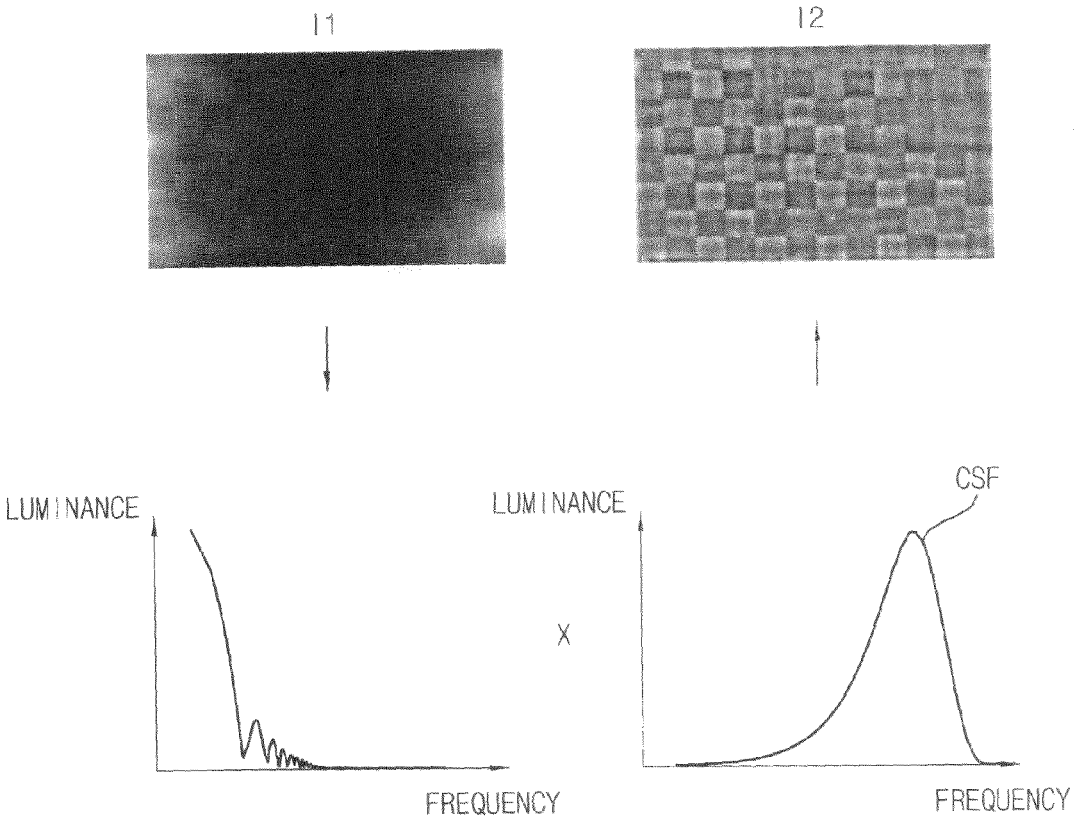
FIG. 3 is a conceptual diagram illustrating a method of generating a contrast sensitivity adjusted image by the contrast sensitivity applying part of FIG. 2.

FIG. 3 is a conceptual diagram illustrating a method of generating the contrast sensitivity adjusted image by the contrast sensitivity applying part 210 of FIG. 2.

Referring to FIGS. 1 to 3, the contrast sensitivity applying part 210 converts the luminance of the input image I1 into a frequency domain. In some embodiments, the contrast sensitivity applying part 210 converts the luminance of the input image I1 to a luminance profile in the frequency domain using a Fourier transform.

The contrast sensitivity applying part 210 multiplies the luminance profile in the frequency domain by a contrast sensitivity function defined in the frequency domain to convert the luminance of the input image I1.

The contrast sensitivity function has a relatively high value for high frequencies and a relatively low value for low frequencies. Thus, the luminance of the input image I1 is high pass filtered by the contrast sensitivity function.

The contrast sensitivity applying part 210 converts the result of the multiplication into the time domain to generate the contrast sensitivity adjusted image I2. The contrast sensitivity applying part 210 convert the result of the multiplication to the contrast sensitivity adjusted image I2 in the time domain using an inverse Fourier transform. The contrast sensitivity adjusted image I2 represents a boundary emphasized image when compared to the input image I1 by the application of the contrast sensitivity.

The contrast sensitivity function is represented by a contrast sensitivity applying mask in the time domain. In some embodiments, the contrast sensitivity applying is a three by three matrix mask. When the contrast sensitivity function is represented by the contrast sensitivity applying mask, the number of required calculations decreases resulting in a decrease in required logic functionality.

Figure 4A:
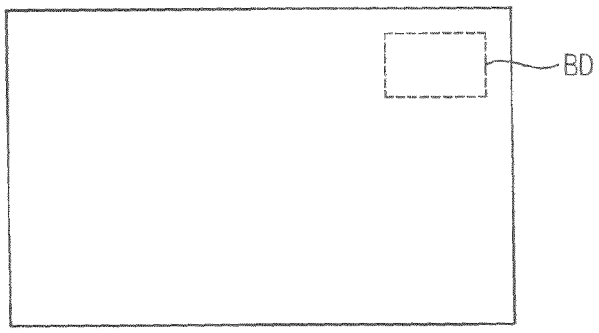
FIGS. 4A to 4C are conceptual diagrams illustrating a step of compensating a burn-in causing boundary.
Figure 4B:
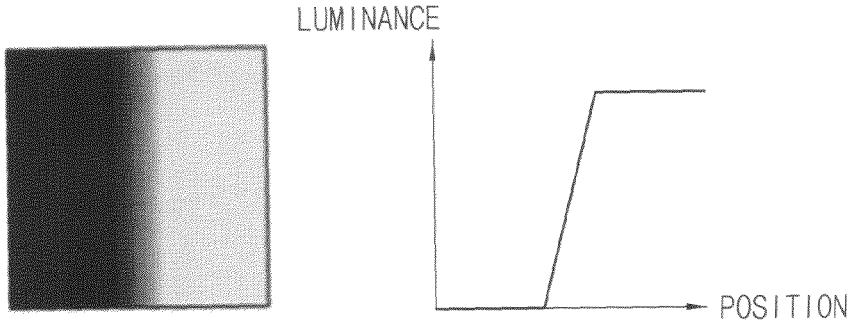
Figure 4C:
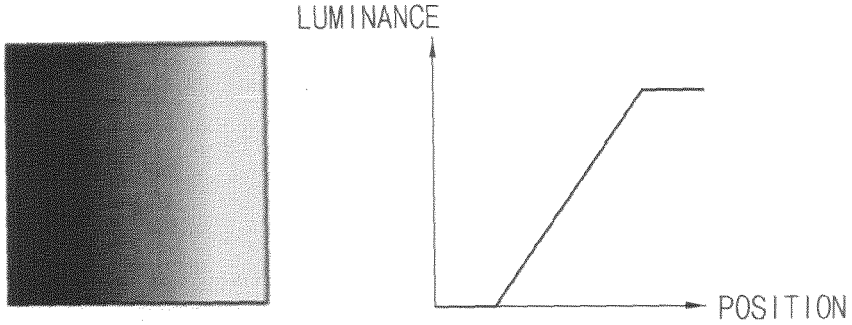
Figure 5A:
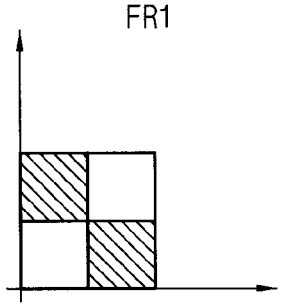
FIGS. 5A to 5E are conceptual diagrams illustrating a step of compensating a burn-in causing boundary.
Figure 5B:
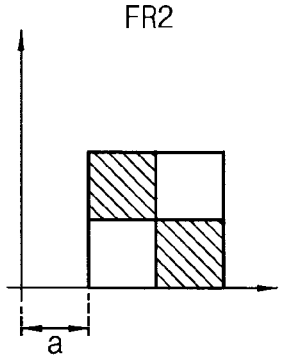
Figure 5C:
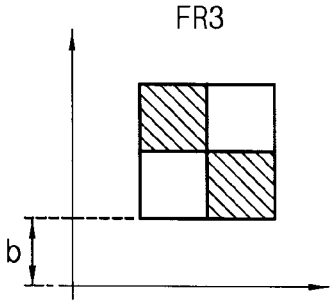
Figure 5D:
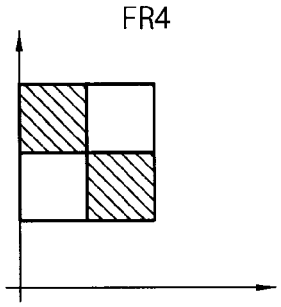
Figure 5E:
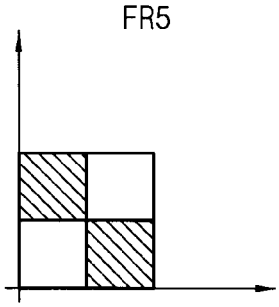

FIGS. 4A to 4C are conceptual diagrams illustrating a step of compensating an burn-in causing boundary by the compensating part 270 of FIG. 2.

Referring to FIGS. 1 to 4C, FIG. 4A represents the input image and the burn-in causing boundary BD is located in the input image.

The compensating part 270 compensates the input image by filtering a portion corresponding to the burn-in causing boundary BD using an unsharpening filter.

The unsharpening filter may be an averaging filter. In some embodiments, the unsharpening filter is $$\begin{pmatrix} 1/9 & 1/9 & 1/9 \\ 1/9 & 1/9 & 1/9 \\ 1/9 & 1/9 & 1/9 \end{pmatrix}.$$

FIG. 4B represents an image corresponding to the burn-in causing boundary BD before applying the unsharpening filter. FIG. 4C represents an image corresponding to the burn-in causing boundary BD after the application of the unsharpening filter. As shown in FIG. 4C, the burn-in causing boundary BD is blurred after the application of the unsharpening filter.

The burn-in causing boundary BD is blurred so that luminance difference at the burn-in causing boundary BD is rarely shown to the viewer. Thus, burn-in of the image on the display panel 100 can be mitigated.

The method of compensating the burn-in according to at least one embodiment can be applied to an LCD panel or an OLED display panel.

According to at least one embodiment, the burn-in causing boundary is accurately determined using the first derivative and the second derivative of the contrast sensitivity adjusted image. When the burn-in causing boundary is generated, the input image is compensated so that burn-in of the image on the display panel 100 is reduced. Thus, the display quality of the display panel 100 is improved.

FIGS. 5A to 5E are conceptual diagrams illustrating a step of compensating an burn-in causing boundary by a compensating part 270 according to an exemplary embodiment.

The method of compensating the image on the display panel according to the embodiment of FIG. 5 is substantially the previously described method of FIGS. 1 to 4C except for the method of compensating the burn-in causing boundary. Thus, the same reference numerals will be used to refer to the same or like parts as those described in the previous embodiment and any repetitive explanation concerning the above elements will be omitted.

Referring to FIGS. 1 to 3 and 5A to 5E, the display device includes a display panel 100 and a panel driver. The panel driver includes a timing controller 200, a gate driver 300, a gamma reference voltage generator 400 and a data driver 500.

The display panel 100 has a display region on which an image is displayed and a peripheral region adjacent to the display region.

The display panel 100 may be an LCD panel including a liquid crystal layer. Alternatively, the display panel 100 may be an OLED display panel including a plurality of OLEDs.

The timing controller 200 generates a first control signal CONT1, a second control signal CONT2, a third control signal CONT3, and a data signal DATA based on the input image data RGB and the input control signal CONT.

The timing controller 200 may generate a contrast sensitivity adjusted image based on the input image data RGB. The timing controller 200 may analyze the contrast sensitivity adjusted image to determine a burn-in causing boundary. The timing controller 200 may compensate the burn-in causing boundary to generate the data signal DATA.

The timing controller 200 includes a contrast sensitivity applying part or contrast sensitivity application module 210, a gradient analyzing part or gradient analysis module 230, a local maximum analyzing part or local maximum analysis module 240, a boundary determining part or boundary determining module 250, a compensation determining part or compensation determining module 260, and a compensating part or compensation module 270. The timing controller 200 may further include a luminance analyzing part or luminance analysis module 220.

The contrast sensitivity applying part 210 adjusts the contrast sensitivity of the input image RGB to generate the contrast sensitivity adjusted image.

The luminance analyzing part 220 analyzes the luminance of each pixel of the contrast sensitivity adjusted image.

The gradient analyzing part 230 analyzes a first derivative of the luminance of each pixel of the contrast sensitivity adjusted image.

The local maximum analyzing part 240 analyzes a second derivative of the luminance of each pixel of the contrast sensitivity adjusted image.

The boundary determining part 250 determines a burn-in causing boundary based on an accumulated first derivative, an accumulated second derivative, and a burn-in causing threshold. The boundary determining part 250 determines a burn-in causing degree using a weighted sum of the accumulated first derivative and the accumulated second derivative.

The boundary determining part 250 compares the burn-in causing degree and the burn-in causing threshold. When the burn-in causing degree is greater than the burn-in causing threshold, the boundary determining part 250 determines the boundary of the display image as the burn-in causing boundary.

When the burn-in causing boundary is determined by the boundary determining part 250, the compensation determining part 260 compares the burn-in causing boundary and a boundary pattern of a current input image to determine whether burn-in compensation should be applied.

When the compensation determining part 260 determines to compensate the burn-in of the current input image, the compensating part 270 compensates the burn-in of the current input image.

In the embodiment of FIG. 5, the compensating part 270 compensates the current input image by displacing the input image in different for each frame of the compensation.

As shown in FIG. 5, the display panel 100 displays the input image at a first position in a first frame FR1 under the control of the compensating part 270.

The display panel 100 displays the input image at a second position in a second frame FR2 under the control of the compensating part 270. The second position is displaced by a distance a in a first direction from the first position.

The display panel 100 displays the input image at a third position in a third frame FR3 under the control of the compensating part 270. The third position is displaced by a distance b in a second direction crossing the first direction from the second position.

The display panel 100 displays the input image at a fourth position in a fourth frame FR4 under the control of the compensating part 270. The fourth position is displaced by a distance—a in the first direction from the third position.

The display panel 100 displays the input image at the first position in a fifth frame FR5.

As explained above, the compensating part 270 displaces the image on the display panel 100 in a four frame cycle.

The distances of a and b may be determined according to the burn-in causing degree determined based on the first derivative and the second derivative. In some embodiments, when the burn-in causing degree increases, the distances a and b increase. When the burn-in causing degree decreases, the distances a and b decrease.

In some embodiments, the distance a is substantially the same as the distance b. The distance a represents the number of pixel widths of displacement in the first direction. The distance b represents the number of pixel widths of displacement in the second direction.

As explained above, the image on the display panel 100 moves at a high velocity so that the burn-in boundary BD is blurred such that luminance difference at the burn-in causing boundary BD is rarely shown to the viewer. Thus, the burn-in of the image on the display panel 100 can be reduced.

The method of compensating the burn-in according to the embodiment of FIG. 5 can be applied to an LCD panel or an OLED display panel.

According to the embodiment of FIG. 5, the burn-in causing boundary may be accurately determined using the first derivative and the second derivative of the contrast sensitivity adjusted image. When the burn-in causing boundary is generated in the input image, the input image is compensated so that the burn-in of the image on the display panel 100 is reduced. Thus, the display quality of the display panel 100 is improved.

Figure 6A:
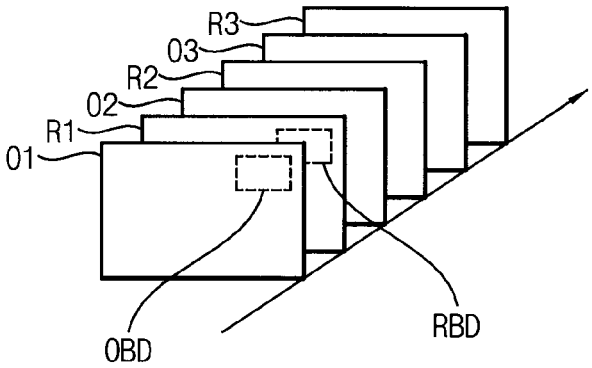
FIGS. 6A to 6B are conceptual diagrams illustrating a step of compensating a burn-in causing boundary.
Figure 6B:
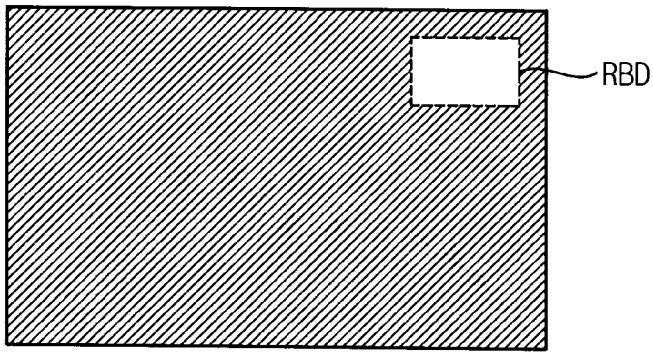

FIGS. 6A to 6B are conceptual diagrams illustrating a step of compensating a burn-in causing boundary by a compensating part 270 according to an exemplary embodiment.

The method of compensating the image on the display panel according to the embodiment of FIG. 6 is substantially the same as method of compensating the image on the display panel of the previous embodiment of FIGS. 1 to 4C except for the method of compensating the burn-in boundary. Thus, the same reference numerals will be used to refer to the same or like parts as those described in the previous embodiment and any repetitive explanation concerning the above elements will be omitted.

Referring to FIGS. 1 to 3 and 6A and 6B, the display device includes a display panel 100 and a panel driver. The panel driver includes a timing controller 200, a gate driver 300, a gamma reference voltage generator 400, and a data driver 500.

The display panel 100 has a display region on which an image is displayed and a peripheral region adjacent to the display region.

The display panel 100 may be an LCD panel including a liquid crystal layer. Alternatively, the display panel 100 may be an OLED display panel including a plurality of OLEDs.

The timing controller 200 generates a first control signal CONT1, a second control signal CONT2, a third control signal CONT3, and a data signal DATA based on the input image data RGB and the input control signal CONT.

The timing controller 200 generates a contrast sensitivity adjusted image based on the input image data RGB. The timing controller 200 analyzes the contrast sensitivity adjusted image to determine a burn-in causing boundary. The timing controller 200 compensates the burn-in causing boundary to generate the data signal DATA.

The timing controller 200 includes a contrast sensitivity applying part or contrast sensitivity application module 210, a gradient analyzing part or gradient analysis module 230, a local maximum analyzing part or local maximum analysis module 240, a boundary determining part or boundary determination module 250, a compensation determining part or compensation determination module 260 and a compensating part or compensation module 270. The timing controller 200 may further include a luminance analyzing part or luminance analysis module 220.

The contrast sensitivity applying part 210 adjusts the contrast sensitivity of the input image RGB to generate the contrast sensitivity adjusted image.

The luminance analyzing part 220 analyzes the luminance of each pixel of the contrast sensitivity adjusted image.

The gradient analyzing part 230 analyzes a first derivative of the luminance of each pixel of the contrast sensitivity adjusted image.

The local maximum analyzing part 240 analyzes a second derivative of the luminance of each pixel of the contrast sensitivity adjusted image.

The boundary determining part 250 determines a burn-in causing boundary based on an accumulated first derivative and an accumulated second derivative. The boundary determining part 250 may determine a burn-in causing degree using a weighted sum of the accumulated first derivative and the accumulated second derivative.

The boundary determining part 250 compares the burn-in causing degree and a burn-in causing threshold. When the burn-in causing degree is greater than the burn-in causing threshold, the boundary determining part 250 determines the boundary of the displayed image as the burn-in causing boundary.

When the burn-in causing boundary is determined by the boundary determining part 250, the compensation determining part 260 compares the burn-in causing boundary and a boundary pattern of a current input image to determine whether to apply the burn-in compensation.

When the compensation determining part 260 determines to compensate the burn-in of the current image, the compensating part 270 compensates the burn-in of the current image.

In the embodiment of FIG. 6, the compensating part 270 inserts compensating images R1, R2 and R3 between original input images O1, O2 and O3 to compensate the current input image.

The compensating images R1, R2 and R3 may include a first compensating portion RBD corresponding to the burn-in causing boundary and a second compensating portion not corresponding to the burn-in causing boundary.

In some embodiments, the first compensating portion RBD is generated by converting an original boundary portion OBD of the original input image corresponding to the burn-in causing boundary. In these embodiments, the first compensating portion RBD is generated by applying a mask $$\begin{pmatrix} 0 & 1 & 0 \\ 1 & -4 & 1 \\ 0 & 1 & 0 \end{pmatrix}$$

to the original boundary portion OBD of the original input image corresponding to the burn-in causing boundary.

In some embodiments, the second compensating portion not corresponding to the burn-in causing boundary displays a black image.

In other embodiments, the second compensating portion not corresponding to the burn-in causing boundary displays a gray image corresponding to an average of luminance of the original input images O1, O2 and O3. In these embodiments, the second compensating portion of a first compensating image R1 displays a gray image corresponding to an average of luminance of a first original input image O1. The second compensating portion of a second compensating image R2 displays a gray image corresponding to an average of luminance of a second original input image O2. The second compensating portion of a third compensating image R3 displays a gray image corresponding to an average of luminance of a third original input image O3.

The method of compensating burn-in according to the embodiment of FIG. 6 can be applied to an LCD panel.

According to the embodiment of FIG. 6, the burn-in causing boundary is accurately determined using the first derivative and the second derivative of the contrast sensitivity adjusted image. When the burn-in causing boundary is generated, the input image is compensated so that the burn-in of the image on the display panel 100 decreases. Thus, the display quality of the display panel 100 is improved.

Figure 7A:
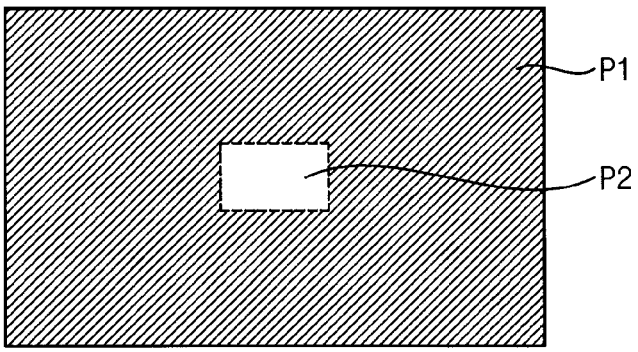
FIGS. 7A to 7C are conceptual diagrams illustrating a step of compensating a burn-in causing boundary.
Figure 7B:
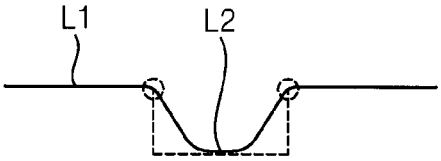
Figure 7C:
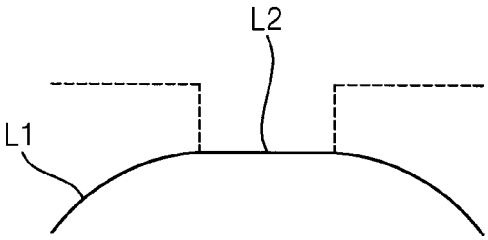

FIGS. 7A to 7C are conceptual diagrams illustrating a step of compensating a burn-in causing boundary by a compensating part 270 according to an exemplary embodiment.

Referring to FIGS. 1 to 3 and 7A to 7C, the display device includes a display panel 100 and a panel driver. The panel driver includes a timing controller 200, a gate driver 300, a gamma reference voltage generator 400, and a data driver 500.

The display panel 100 has a display region on which an image is displayed and a peripheral region adjacent to the display region.

The display panel 100 may be an LCD panel including a liquid crystal layer. Alternatively, the display panel 100 may be an OLED display panel including a plurality of OLEDs.

The timing controller 200 generates a first control signal CONT1, a second control signal CONT2, a third control signal CONT3, and a data signal DATA based on the input image data RGB and the input control signal CONT.

The timing controller 200 generates a contrast sensitivity adjusted image based on the input image data RGB. The timing controller 200 analyzes the contrast sensitivity adjusted image to determine a burn-in causing boundary. The timing controller 200 compensates the burn-in causing boundary to generate the data signal DATA.

The timing controller 200 includes a contrast sensitivity applying part or contrast sensitivity application module 210, a luminance analyzing part or luminance application module 220, a gradient analyzing part or gradient analysis module 230, a local maximum analyzing part or local maximum analysis module 240, a boundary determining part or boundary determining module 250, a compensation determining part or compensation determining module 260 and a compensating part or compensating module 270.

The contrast sensitivity applying part 210 adjusts the contrast sensitivity of the input image RGB to generate the contrast sensitivity adjusted image.

The luminance analyzing part 220 analyzes luminance of each pixel of the contrast sensitivity adjusted image.

The gradient analyzing part 230 analyzes a first derivative of the luminance of each pixel of the contrast sensitivity adjusted image.

The local maximum analyzing part 240 analyzes a second derivative of the luminance of each pixel of the contrast sensitivity adjusted image.

The boundary determining part 250 determines a burn-in causing boundary based on an accumulated first derivative and an accumulated second derivative. The boundary determining part 250 may determine a burn-in causing degree using a weighted sum of the accumulated first derivative and the accumulated second derivative.

The boundary determining part 250 compares the burn-in causing degree and a burn-in causing threshold. When the burn-in causing degree is greater than the burn-in causing threshold, the boundary determining part 250 determines the boundary of the display image as the burn-in causing boundary.

When the burn-in causing boundary is determined by the boundary determining part 250, the compensation determining part 260 determine whether to compensate the burn-in based on an accumulated luminance and a difference between the burn-in causing boundary and a boundary of the current input image.

When the compensation determining part 260 determines to compensate the burn-in of the current input image, the compensating part 270 compensates the burn-in of the current input image.

According to some embodiments, the display panel 100 is an OLED display panel. The display panel 100 includes a first portion P1 having a relatively low accumulated luminance and a second portion P2 having a relatively high accumulated luminance. For example, the first portion P1 having a relatively low accumulated luminance may represent a luminance of 100%. In contrast, the second portion P2 having a relatively high accumulated luminance is deteriorated so that the second portion P2 may represent a luminance of 80%. In some embodiments, the relatively low accumulated luminance is determined by comparing the accumulated luminance to a first predetermined luminance and the relatively high accumulated luminance is determined by comparing the accumulated luminance to a second predetermined luminance.

The compensating part 270 increases the luminance of an image displayed at the second portion P2 having the high accumulated luminance or decreases the luminance of an image displayed at the first portion P1 having the low accumulated luminance to compensate the current input image.

In FIG. 7B, the compensating part 270 increases the luminance of an image displayed in the second portion P2. When the luminance of the second portion P2 is entirely and uniformly increased, OLEDs in the second portion P2 may be deteriorated quickly.

The luminance applied to pixels near the boundary increases as the distance from the pixels to the second portion P2 decreases.

At the boundary portion between the first portion P1 and the second portion P2 which is easily recognized by a user, the difference of luminance is low enough that the burn-in is not easily recognized by the user. In addition, the deterioration of the OLEDs in the second portion P2 may be slowed.

In FIG. 7C, the compensating part 270 decreases luminance of an image displayed at the first portion P1. The luminance applied to pixels near the boundary decreases as the distance from the pixels to the first portion P1 increases.

At the boundary portion between the first portion P1 and the second portion P2 which is easily recognized by a user the difference of luminance is low enough that the burn-in is not easily recognized by the user. In addition, the luminance of pixels outside of the first portion P1 is decreased so that the deterioration of the OLEDs in the first portion P1 may be slowed.

In the embodiment of FIG. 7, the method of compensating the burn-in is applied to an OLED display panel.

According to the FIG. 7 embodiment, the burn-in causing boundary may be accurately determined using the first derivative and the second derivative of the contrast sensitivity adjusted image. When the burn-in causing boundary is generated, the input image is compensated so that the burn-in of the image on the display panel 100 is decreased. Thus, the display quality of the display panel 100 is improved.

Figure 8:
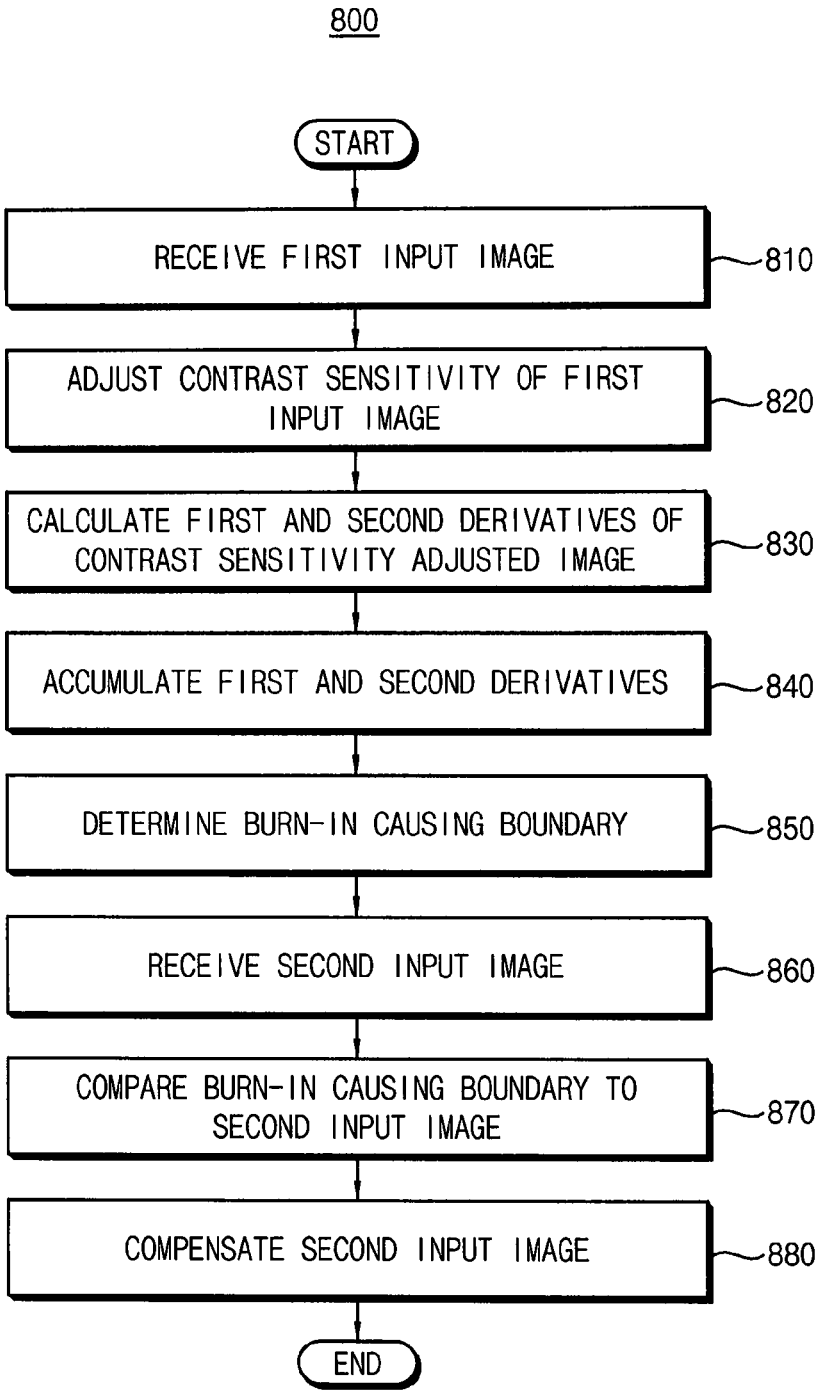
FIG. 8 is a flowchart showing an exemplary operation or procedure 800 for compensating an image displayed on a display panel according to one embodiment.

FIG. 8 is a flowchart showing an exemplary operation or procedure 800 for compensating an image displayed on a display panel according to one embodiment. Depending on the embodiment, additional states may be added, others removed, or the order of the states changed in FIG. 8. In state 810, a first input image is received from an external source. In state 820, the contrast sensitivity of the first input image is adjusted. In state 830, first and second derivatives of the luminance of a pixel included in the contrast sensitivity adjusted image are calculated. In state 840, the first and second derivatives are respectively accumulated. In state 850, a burn-in causing boundary is determined based on the accumulated first and second derivatives. In state 860, a second input image is received from the external source. In state 870, the burn-in causing boundary is compared to a boundary of the second input image to determine whether to apply burn-in compensation. In state 880, a portion of the second input image corresponding to the burn-in causing boundary is compensated.

In some embodiments, the procedure 800 is implemented in a conventional programming language, such as C or C++ or another suitable programming language. In one embodiment, the program is stored on a computer accessible storage medium of the display device. In another embodiment, the program is stored in a separate storage medium. The storage medium may include any of a variety of technologies for storing information. In one embodiment, the storage medium includes a random access memory (RAM), hard disks, floppy disks, digital video devices, compact discs, video discs, and/or other optical storage mediums, etc. In another embodiment, the timing controller 200 is configured to or programmed to perform at least part of the procedure 800. The program may be stored in the processor. In various embodiments, the processor may have a configuration based on, for example, i) an advanced RISC machine (ARM) microcontroller and ii) Intel Corporation's microprocessors (e.g., the Pentium family microprocessors). In one embodiment, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 7/Vista/2000/9x/ME/XP, Macintosh OS, OS/2, Android, iOS and the like. In another embodiment, at least part of the procedure 800 can be implemented with embedded software.

According to at least one embodiment as explained above, the burn-in can be effectively compensated. Thus, the display quality of the display panel is improved.

The foregoing is illustrative of the described technology and is not to be construed as limiting thereof. Although a few exemplary embodiments have been described, those skilled in the art will readily appreciate that many modifications are possible in the exemplary embodiments without materially departing from the novel teachings and advantages of the described technology. Accordingly, all such modifications are intended to be included within the scope of the described technology as defined in the claims. In the claims, means-plus-function clauses are intended to cover the structures described herein as performing the recited function and not only structural equivalents but also equivalent structures. Therefore, it is to be understood that the foregoing is illustrative of the described technology and is not to be construed as limited to the specific exemplary embodiments disclosed and that modifications to the disclosed exemplary embodiments, as well as other exemplary embodiments, are intended to be included within the scope of the appended claims. The described technology is defined by the following claims, with equivalents of the claims to be included therein.

What is claimed is:

1. A method of compensating an image to be displayed on a display panel including a plurality of pixels, the method comprising:

receiving a first input image;

adjusting a contrast sensitivity of the first input image by emphasizing a boundary of the first input image, the adjusting comprising:

converting the first input image into a frequency domain, multiplying the converted first input image with a contrast sensitivity function, wherein the contrast sensitivity function is configured to adjust a perceived difference in luminance of the boundary in the adjusted image to be closer to a difference in luminance of the boundary in the first input image, and converting the result of the multiplication into a time domain;

calculating a first derivative of luminance of a pixel included in the contrast sensitivity adjusted image in which the boundary in the adjusted image is emphasized;

calculating a second derivative of the luminance of the pixel included in the contrast sensitivity adjusted image in which the boundary in the adjusted image is emphasized;

accumulating the first and second derivatives;

determining a burn-in causing boundary based at least in part on a weighted sum of the accumulated first and second derivatives of the luminance of the pixel included in the contrast sensitivity adjusted image in which the boundary in the adjusted image is emphasized;

receiving a second input image;

comparing the burn-in causing boundary to a boundary of the second input image to determine whether to apply burn-in compensation; and compensating, at a controller, a portion of the second input image corresponding to the burn-in causing boundary based at least in part on an unsharpening filter.

2. The method of claim 1, wherein the calculating of the first derivative includes using a first mask, wherein the first mask comprises at least one of the following matrices:

$$\begin{pmatrix} -1 & -2 & -1 \\ 0 & 0 & 0 \\ 1 & 2 & 1 \end{pmatrix} \text{ and } \begin{pmatrix} -1 & 0 & 1 \\ -2 & 0 & 2 \\ -1 & 0 & 1 \end{pmatrix}.$$

3. The method of claim 2, wherein the calculating of the second derivative includes using a second mask, wherein the second mask comprises at least one of the following matrices:

$$\begin{pmatrix} 0 & 1 & 0 \\ 1 & -4 & 1 \\ 0 & 1 & 0 \end{pmatrix}, \begin{pmatrix} 0 & -1 & 0 \\ -1 & 4 & -1 \\ 0 & -1 & 0 \end{pmatrix}, \begin{pmatrix} 1 & 1 & 1 \\ 1 & -8 & 1 \\ 1 & 1 & 1 \end{pmatrix} \text{ and } \begin{pmatrix} -1 & -1 & -1 \\ -1 & 8 & -1 \\ -1 & -1 & -1 \end{pmatrix}.$$

4. The method of claim 1, further comprising determining the luminance of the pixel included in the contrast sensitivity adjusted image.

5. The method of claim 4, further comprising:

accumulating the luminance; and calculating an additional weighted sum of the accumulated luminance, the accumulated first derivative, and the accumulated second derivative.

6. The method of claim 1, wherein the unsharpening filter comprises an averaging filter.

7. A display device, comprising:

a display panel comprising a plurality of pixels;

a data driver configured to apply data signals to the pixels; and a controller configured to receive first and second input images and control the data driver based at least in part on a burn-in causing boundary of the first input image, wherein the controller is further configured to adjust a contrast sensitivity of the first input image by emphasizing a boundary of the first input image, wherein the controller is further configured to at least partially compensate the second input image based at least in part on the burn-in causing boundary, wherein the controller is further configured to determine the burn-in causing boundary based at least in part on the contrast sensitivity adjusted image, and wherein the controller is further configured to execute software that comprises:

a contrast sensitivity adjuster configured to adjust the contrast sensitivity of the first input image, the adjusting including:

converting the first input image into a frequency domain, multiplying the converted first input image with a contrast sensitivity function, wherein the contrast sensitivity function is configured to adjust a perceived difference in luminance of the boundary in the adjusted image to be closer to a difference in luminance of the boundary in the first input image, and converting the result of the multiplication into a time domain, a gradient analyzer configured to calculate a first derivative of the luminance of a pixel included in the adjusted image and accumulate the first derivative;

a local maximum analyzer configured to calculate a second derivative of the luminance of the pixel and accumulate the second derivative;

a boundary determination module configured to determine the burn-in causing boundary based on a weighted sum of the accumulated first and second derivatives of the luminance of the pixel included in the contrast sensitivity adjusted image in which the boundary in the adjusted image is emphasized.

8. The display device of claim 7, wherein the controller is further configured to execute software that comprises:

a compensation determination module configured to determine whether to apply burn-in compensation based on the burn-in causing boundary and the second input image; and a compensator configured to compensate a portion of the second input image corresponding to the burn-in causing boundary.

* * * * *